US006070331A

United States Patent [19]

Dempsey

[11] Patent Number: 6,070,331

[45] **Date of Patent: *Jun. 6, 2000**

[54] SCORING AND MARKING APPARATUS HAVING STABILIZING WINGS

[75] Inventor: Gregory S. Dempsey, Glen Ellyn, Ill.

[73] Assignee: Johnson Level & Tool Mfg. Co., Inc., Mequon, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/748,713

[22] Filed: Nov. 14, 1996

Related U.S. Application Data

[60] Provisional application No. 60/006,806, Nov. 15, 1995.

[51] Int. Cl.[7] ..... B43L 13/02

[52] U.S. Cl. ..... 33/42; 33/479

[58] Field of Search ..... 33/42, 479, 485, 33/486, 448

[56] References Cited

U.S. PATENT DOCUMENTS

| | | | |
|---|---|---|---|
| 171,927 | 1/1876 | Farnham et al. . | |
| 844,243 | 2/1907 | Breul . | |
| 885,226 | 4/1908 | Cowles | 33/42 |
| 991,693 | 5/1911 | Brown . | |
| 1,053,083 | 2/1913 | Blizard et al. . | |
| 1,195,886 | 8/1916 | Wheeler | 33/42 |
| 1,298,995 | 4/1919 | Michalvitz | 33/448 |
| 1,598,993 | 9/1926 | Vlanzy | 33/42 |
| 1,614,812 | 1/1927 | Trane et al. | 33/485 |
| 1,877,185 | 9/1932 | Lowe | 33/42 |
| 2,007,329 | 7/1935 | Flesselles | 33/485 |
| 3,174,225 | 3/1965 | Abraham | 33/42 |
| 3,192,630 | 7/1965 | Dineson | 33/42 |
| 4,494,434 | 1/1985 | Young | 83/745 |
| 4,503,624 | 3/1985 | Whiteford | 33/42 |
| 4,574,492 | 3/1986 | Miller | 33/427 |
| 4,669,197 | 6/1987 | Griew | 33/403 |
| 4,903,409 | 2/1990 | Kaplan et al. | 30/293 |
| 4,956,919 | 9/1990 | Granger . | |
| 5,083,375 | 1/1992 | Helm, Sr. | 30/294 |
| 5,103,570 | 4/1992 | Nichols | 33/479 |
| 5,197,195 | 3/1993 | Aikens . | |
| 5,231,764 | 8/1993 | Chang | 30/293 |
| 5,253,426 | 10/1993 | Mosbrucker | 33/429 |
| 5,265,342 | 11/1993 | Lang, Jr. | 30/294 |
| 5,309,642 | 5/1994 | McGinnis | 33/32.2 |
| 5,459,937 | 10/1995 | Albin et al. | 33/479 |
| 5,471,753 | 12/1995 | Rodrigues | 33/42 |
| 5,539,991 | 7/1996 | Harrison | 33/42 |

FOREIGN PATENT DOCUMENTS

| | | | |
|---|---|---|---|
| 1282647 | 12/1962 | France | 33/479 |
| 84466 | 4/1895 | Germany . | |
| 592615 | 1/1934 | Germany | 33/42 |

*Primary Examiner*—G. Bradley Bennett
*Attorney, Agent, or Firm*—Andrus, Sceales, Starke & Sawall

[57] ABSTRACT

An apparatus for marking and scoring sheet material having a side edge includes a base having an upper surface and a contact edge adapted to engage a side edge of the sheet material. A trans-base is secured perpendicularly to the base and is adapted to rest on the upper surface of the sheet material. The base and the trans-base are susceptible to rocking movement about a fulcrum defined by the trans-base as the contact edge of the base is drawn along the side edge of the sheet material. Stabilizing wing structure on the base is constructed and arranged to prevent any such rocking movement of the base and the trans-base as the contact edge is drawn along the side edge of the sheet material. The stabilizing wing structure includes an upturned side edge maintained out of engagement with the sheet material upper surface, to prevent the wing structure from engaging irregularities in the sheet material upper surface as the base contact edge is drawn along the sheet material side edge.

6 Claims, 2 Drawing Sheets

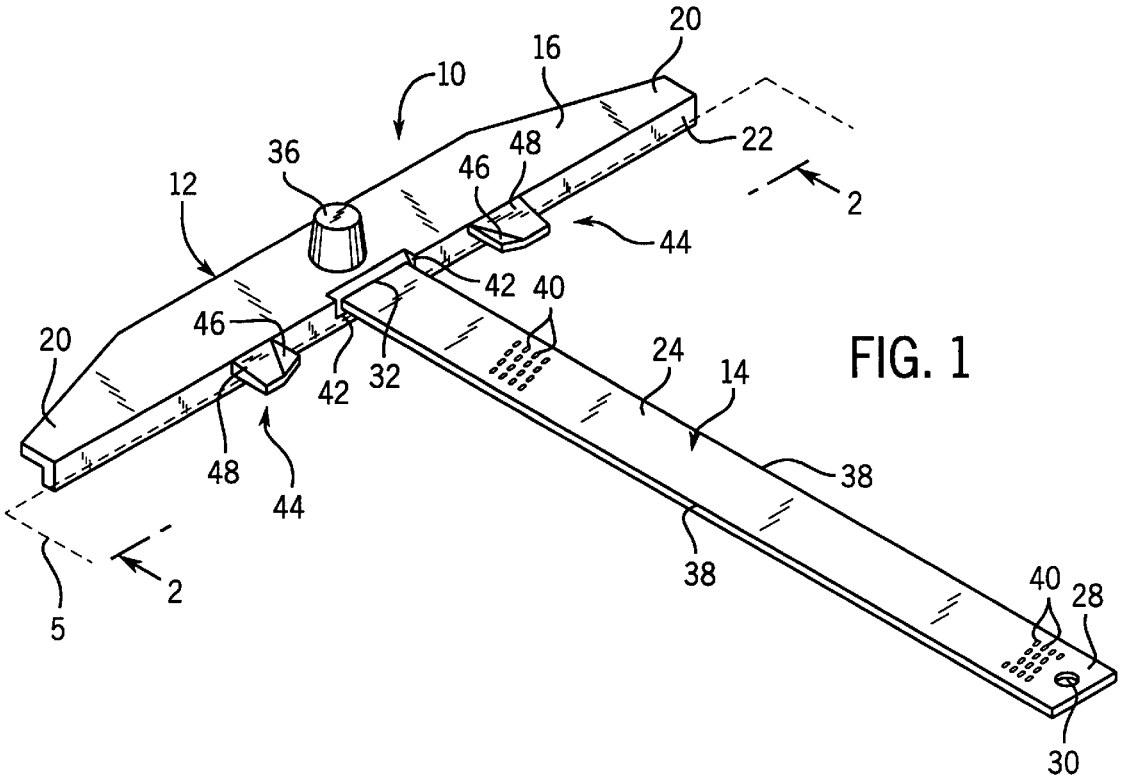
FIG. 1
FIG. 2
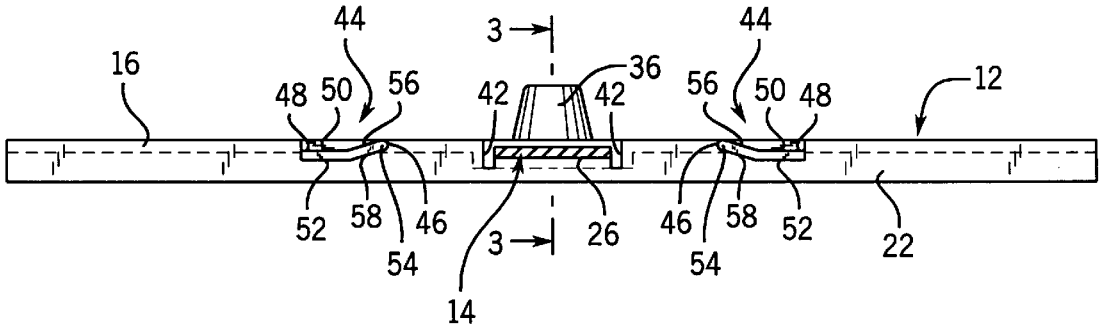

SCORING AND MARKING APPARATUS HAVING STABILIZING WINGS

CROSS-REFERENCE TO RELATED APPLICATIONS

This application is based on and claims priority from Provisional Application Serial No. 60/006,806 filed Nov. 15, 1995.

STATEMENT REGARDING FEDERALLY SPONSORED RESEARCH OR DEVELOPMENT

Not applicable.

BACKGROUND OF THE INVENTION

The present invention relates generally to measuring tools such as used by carpenters or other tradesmen, and more particularly, pertains to a stabilized square device adapted to mark or score material.

The present invention is a further improvement to well known square tools or devices having a base and a trans-base interconnected at right angles. The square devices are designed to measure and to mark or score perpendicularly or parallel to the edge of construction sheet materials such as plywood or drywall. The base of the square device has a lip or contact edge which is pushed flush against an edge of the sheet material. The mark or score is made with a pencil or knife, respectively, carefully coordinating the motion of one's hands on the base and the trans-base, using one of the parallel edges of the trans-base to create a perpendicular mark or score or an array of spaced slots provided along the trans-base to establish a parallel mark or score.

It has been discovered that most prior art square devices will not perform efficiently on material in excess of 8 inches in length because of the construction of their bases. That is, the bases embodied in the previous square devices do not provide the support and stability needed to work effectively and accurately with proper speed on larger pieces of standard size 4 foot by 8 foot sheet material when marking or scoring. For example, in cases where the base and trans-base define a T-type square, the base will sometimes swivel or rock about the longitudinal axis of the trans-base. This instability of the base during use of the square device impairs the scoring and marking capability of the tool.

Accordingly, it is desirable to provide a scoring and marking apparatus which will overcome the above-noted problems by supplying a simplified and reliable stabilizing arrangement which will prevent rocking or pivoting movement of the base as the base is moved along the edge of the workpiece. It is also desirable to provide such a stabilized base structure which prevents the stabilizing arrangement from catching on or digging into the workpiece to prevent destructive invasion as the contact edge of the base comes into engagement with the workpiece and is moved along the workpiece.

BRIEF SUMMARY OF THE INVENTION

The present invention advantageously provides a guided scoring and marking apparatus having stabilizing structure for broadening support of the base in a manner which will allow the apparatus to achieve greater speed, precision and overall efficiency.

It is one object of the present invention to supply a square-type tool having a greater degree of control which is less susceptible to rocking or rotating relative to the sheet material being scored or marked.

It is another object of the present invention to provide a marking and scoring instrument having a balanced base which will help avert any hang-ups on the sheet material as the base is drawn along the side edge of the sheet material.

It is a further object of the present invention to provide a scoring and marking instrument which can make both parallel and perpendicular marks and scores relative to an edge of the sheet material, and do so without requiring a high level of skill or experience.

Another object of the present invention is to provide an instrument which is easily used by both tradesmen and novices to make marks and scores in construction sheets and other materials more efficiently, accurately and reliably.

Yet another object of the present invention is to provide an instrument which will increase the speed, accuracy and safety with which marks and scores are made on construction sheets and other materials.

In one aspect of the invention, an apparatus for marking and scoring sheet material having an upper surface and a side edge includes a base having a contact edge adapted to engage the side edge of the sheet material. A trans-base is secured perpendicularly to the base and has a lower surface adapted to rest on the upper surface of the sheet material. An instrument having this general construction would normally be susceptible to rocking movement about a fulcrum on the trans-base as the contact edge is drawn along the side edge of the sheet material. In accordance with the invention, a stabilizing structure is provided on the base and is constructed and arranged to restrain the rocking movement of the base and the trans-base as the contact edge is drawn along the side edge of the sheet material. The stabilizing structure is constructed so as not to dig into or damage the sheet material as the base is moved relative to the sheet material. The stabilizing structure is preferably in the form of a pair of stabilizing wings located one on either side of the trans-base. Each extends outwardly from the contact edge in the direction of the trans-base and includes an upturned edge facing inwardly towards the trans-base. Each of the wings has a first planar portion which engages the upper surface of the sheet material, and a second planar portion forming the upturned edge. The first planar portion has a lower surface engageable with the sheet material which is coplanar with the lower surface of the trans-base, and the second planar portion has an upper surface rising upwardly at an angle relative to the first planar portion and the trans-base, and terminating below the upper surface of the base. A pair of spaced notches are formed in the upper surface and the contact edge of the base on opposite sides of the trans-base, and each of the wings is equidistant from the trans-base. The trans-base includes a plurality of apertures adapted to secure and hold a scoring or marking instrument in operative relationship therewith. The trans-base also has a flat planar surface having a distal end spaced from the base and a proximal end secured to the base. The proximal end of the trans-base is formed with a plurality of flow apertures to facilitate molding of the trans-base relative to the base. The base is formed with an integral upstanding handle extending upwardly from its upper surface.

In another aspect of the invention, an apparatus for scoring and marking sheet material has a side edge and an upper flat surface. The apparatus includes an elongated base having an upper surface and a contact edge adapted to engage the side edge of the sheet material. A flat elongated trans-base having first and second elongated parallel straight edges is attached to the base and extends perpendicularly to the contact edge and is adapted to rest on the upper surface of the sheet material. The trans-base includes a plurality of apertures to receive and hold an instrument for making or scoring in operative relationship therewith. The base extends beyond both of the first and second straight edges of the trans-base for engaging the side edge of the sheet material along a substantial distance to either side of the trans-base. A pair of stabilizing wings extend outwardly from the contact edge in the direction of the trans-base, and the wings include upturned edges facing inwardly towards each other and spaced from the trans-base. The wings broaden the support of the apparatus upon the upper surface of the sheet material. When the apparatus is placed on the sheet material with the trans-base resting on the upper surface thereof, the contact edge of the base engages the side edge of the sheet material and at least one of the stabilizing wings is supported on the upper surface of the sheet material. With this construction, any tendency of the apparatus to tilt about one of the trans-base straight edges as the contact edge is drawn along the side edge of the sheet material will be righted by the other of the stabilizing wings. The upturned edges of the wings ensure that the wings do not engage or dig into irregularities in the upper surface of the sheet material, to ensure smooth and even movement of the base along the side edge of the sheet material.

In yet another aspect of the invention, there is contemplated a method for enhancing the stability of a square-type device used to mark and score material having a side edge. The method comprises the steps of supplying a base having a contact edge adapted to engage the side edge of the sheet material; securing a trans-base perpendicularly to the base such that it will overlie the sheet material, the base and the trans-base being susceptible to rocking movement about a fulcrum on the trans-base as the contact edge is drawn along the side edge of the sheet material; and providing stabilizing structure on the base which will restrain the rocking movement of the base and the trans-base as the contact edge is drawn along the side edge of the sheet material without damaging the sheet material.

Various other objects, features and advantages of the invention will be made apparent from the following description taken together with the drawings.

BRIEF DESCRIPTION OF THE SEVERAL VIEWS OF THE DRAWING

The drawings illustrate the best mode presently contemplated of carrying out the invention. In the drawings:

FIG. 1 is an isometric view of the scoring and marking apparatus with stabilizing wings embodying the present invention;

FIG. 2 is an elevational view taken on line 2—2 of FIG. 1;

DETAILED DESCRIPTION OF THE INVENTION

Figure 3:
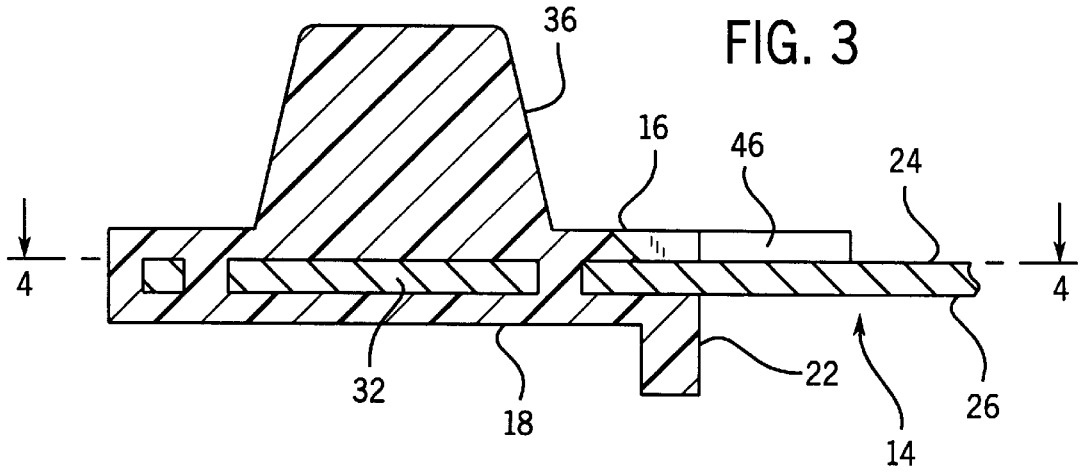
FIG. 3 is an enlarged, fragmentary sectional view taken on line 3—3 of FIG. 2.

Referring now to FIG. 1, there is shown an isometric view of a marking and scoring apparatus 10 constructed according to the invention including an elongated, polygonal base 12 and a flat, elongated, rectangular trans-base or blade 14. Base 12 is a rigid element preferably formed of a suitable thermoplastic material in an injection molding process. Base 12 includes an upper surface 16, a lower surface 18 (FIG. 3), outer ends 20 and a downwardly depending straight contact edge 22 integrally joined at substantially 90° to the upper and lower surfaces 16, 18. As is well known, contact edge 22 is engageable with a side edge of a sheet material S (shown in phantom) requiring marking or scoring.

Figure 4:
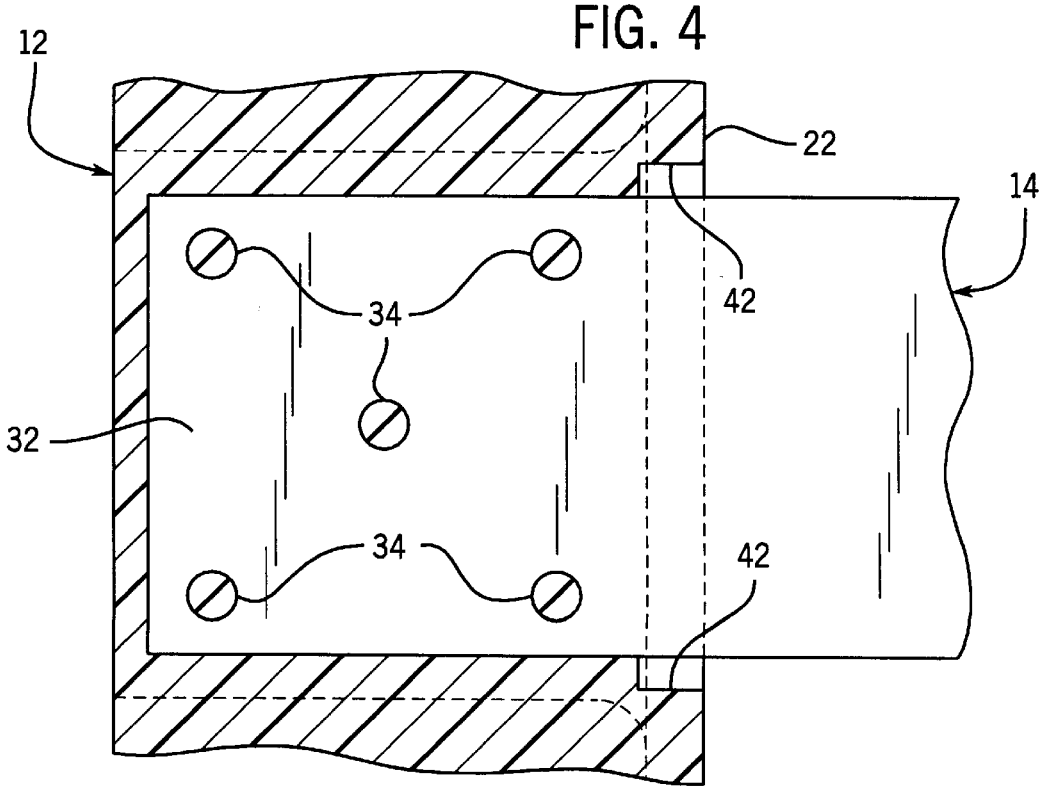
FIG. 4 is an enlarged, fragmentary sectional view taken on line 4—4 of FIG. 3.

Trans-base 14 is a rigid blade-like component having an upper surface 24 and a lower surface 26 which is adapted to overlie and rest on an upper surface of the sheet material S. The trans-base 14 is secured to base 12 in any satisfactory manner, such as by insert molding base 12 about the end portion of trans-base 14. Trans-base 14 extends perpendicularly to, and is located midway along, the length of contact edge 22 to form a T-square. In the preferred embodiment, trans-base 14 has a distal end 28 which is spaced from the contact edge 22 and is provided with a suitable opening 30 from which the T-square may be suspended for storage. Trans-base 14 also has a proximal end 32 which is connected to base 12 via a series of apertures 34 (FIG. 4) formed in base 12, into which the heated thermoplastic material of base 12 flows so as to rigidly secure trans-base 14 to base 12 between the upper and lower surfaces 16, 18 of base 12.

Base 12 also includes an integral upwardly projecting, frustoconically-shaped handle knob 36 for guiding and controlling the apparatus 10 as will be further explained below.

Base 12 is preferably fabricated from molded plastic exhibiting strength and lightweight properties desirable in a construction environment. Other materials such as metal having similar characteristics may be used in forming apparatus 10. It should also be understood that base 12 may be affixed to trans-base 14 in a number of other conventional ways including riveting, threaded fasteners or bonding agents.

Trans-base 14 is preferably a metal member defining first and second elongated straight edges 38 which are parallel to each other and perpendicular to contact edge 22 for enabling scores or marks perpendicular to the side edge of sheet material S. In a manner as is known, measuring scales containing numerical measurement indicia are normally provided on the upper surface of trans-base 14 to represent distances measured from contact edge 22. In addition, trans-base 14 is formed with a series of spaced, staggered apertures or slots 40 for enabling scoring or marking along lines parallel to the side edge of the sheet material S. These slots 40 are more fully described in applicant's copending U.S. Ser. No. 08/649,113 filed May 14, 1996, the disclosure of which is herein incorporated by reference. Slots 40 extend completely through the material of trans-base 14, and are arranged in a continuous repeating pattern along the entire length of trans-base 14 between distal end 30 and proximal end 32. In a preferred form, slots 40 are stamped into trans-base 14 in accordance with conventional technology. Slots 40 are sized and configured to receive the tip of a marking instrument such as a pencil or a scoring instrument such as the blade of a utility knife or the like.

As seen in FIGS. 1 and 2, a pair of notches 42 are formed in base 12, extending between the upper surface 16 and contact edge 22 of base 12 adjacent the straight edges 38 of trans-base 14. Notches 42 facilitate making a mark or score along edges 38 of trans-base 14 adjacent contact edge 22.

The T-square marking and scoring apparatus 10 as constructed above typically has a trans-base 14 which runs 25 inches in length and 2 inches in width while base 12 measures 20–22 inches in length or a substantial distance of about 9–10 inches from each straight edge 38 to an outer end 20 of the base 12. This design provides a reasonably broader base 12 which is significantly more desirable than an L-type square device which has a tendency to rock, rotate or swivel about an edge of the blade when the device is being used to mark or score material thereby affecting accuracy and efficiency of marking and scoring operations. However, depending on where the user's hand pressure is applied, a T-square device having a base and a blade as generally set forth above may also have a tendency to rock, rotate or swivel about a fulcrum defined by a side edge 38 of trans-base 14 as contact edge 22 is drawn along the side edge of sheet material S. This rocking motion is an unwanted characteristic which impairs the speed, precision and overall efficiency during use of such a marking or scoring device.

In order to overcome this problem, the marking and scoring apparatus 10 incorporates twin stabilizing wings 44, which are spaced equidistantly from trans-base side edges 38. In a T-square apparatus having the same general dimensions as set forth above, each wing 44 may be 1½ inches from its respective trans-base side edge 38, although other spacing may function adequately. Each wing 44 extends outwardly from the contact edge 22 in the direction of the trans-base 14 and is formed with an upturned edge 46 which faces inwardly towards the trans-base 14. More specifically, each wing 44 has a flat, generally trapezoidally-shaped, lower planar portion 48 having a top surface 50 and a bottom surface 52, as well as a bent, generally triangularly-shaped angled planar portion 54 having a top surface 56 and a bottom surface 58 defining the upturned edge 46. As seen in FIG. 2, the bottom surface 52 of each lower planar portion 48 is coplanar with lower surface 26 of trans-base 14, while the angled planar portion 54 extends at an angle from flat planar portion 48 and terminates below the upper surface 16 of base 12. In a preferred form, angled planar portion 54 is disposed at an angle of approximately 15° relative to lower planar portion 48. As a result of this construction, support for the square apparatus 10 which previously was derived solely from the trans-base 14, is enhanced by the stabilizing behavior of the wings 44 which act to restrain rocking motion of the device and, due to the orientation of angled planar portions 54, prevent wings 44 from digging into or engaging irregularities in the upper surface of sheet material S.

The drawings show a single angled planar portion 54 associated with each wing 44. It is understood, however, that a similar angled planar portion could be provided on the opposite side of wing 44 from angled planar portion 54 facing in a direction away from tarns-base 14, to ensure wings 44 do not engage irregularities in the surface of sheet material S regardless of the direction of movement of apparatus 10. It is also understood that wings 44 may assume any other configuration and are not limited to the particular configuration shown and described, so long as the wings extend forwardly from contact edge 22, engage the upper surface of sheet S to stabilize base 12, and preferably, have upturned sides to prevent the wings from digging into or engaging irregularities in the surface of sheet material S.

To mark or score the sheet material S, the base 12 is placed next to the side edge of the sheet material S with contact edge 22 in full, flush engagement with the side edge of the sheet material S. This assures that straight edges 38 of the trans-base 14 are perpendicular to the side edge of the sheet material S. The bottom surface 26 of the trans-base 14 rests on the upper surface of the sheet material S, as with a conventional T-square. With one hand holding the base 12 by means of handle knob 36 which permits the user to more easily apply down pressure on the device, the other hand places a marking or scoring instrument in a selected one of slots 40, and both hands move the apparatus 10 along the sheet material S while maintaining the contact edge 22 of the T-square against the side edge of the sheet material S, and the left hand urging the marking or scoring instrument into operative engagement with the sheet material to mark or scores the sheet material in a line parallel to the side edge of sheet material S. In the event a knife is drawn along one of the straight edges 38 to score a perpendicular lines, the inclined edge of the knife will be safely accommodated in one of the notches 42 provided at the intersection between contact edge 22 of base 12 and one of the straight edges 38 on trans-base 14. The notches 42 not only allow a perpendicular mark or score to be made all the way to the contact edge 22, but provide a safety feature in "catching" the cutting edge of the knife to prevent the user from moving the knife rapidly towards himself.

If the scoring or marking begins at an edge or corner of the sheet material S with only one wing 44 in contact with the sheet material, manipulation of the apparatus 10 may cause the other unsupported wing 44 to temporarily drop below the sheet material. However, as hand pressure is adjusted to push the device 10 along the contact edge 22 of the sheet material S, the upturned edge 46 on the other wing 44 will right the apparatus 10 and glide over the sheet material edge in a manner which will not catch on the surface of the sheet material.

Thus, there has been shown an improved T-type marking and scoring apparatus for broadening the support of the base in a manner which is less susceptible to rocking and rotating relative to the sheet material being marked or scored. The square device is particularly useful with large sized sheet material such as used in construction work. The invention provides a balanced base which helps avert any hang-ups on the sheet material during marking and scoring. The invention also provides an improved T-type square which is efficient, easy to use, precise, reliable and safe. The marking and scoring instrument is versatile in that it can facilitate the creation of marks and scores either parallel or perpendicularly to the edge of the sheet material.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. An apparatus for marking and scoring sheet material having a side edge and a surface, comprising:

a blade extending along a longitudinal axis and defining an inner end, an outer end, and an underside adapted to engage the surface of the sheet material, wherein the blade includes a series of spaced openings along its length outwardly of the inner end, and further includes one or more mounting apertures located toward the inner end;

a base formed of a molded material and fixedly secured to the blade toward the inner end of the blade, wherein the material of the base is molded around the inner end of the blade and extends into and through the mounting apertures so as to fixedly secure the base to the blade, wherein the base defines a contact edge substantially perpendicular to the longitudinal axis of the blade;

a pair of stabilizing members associated with the base and located one on either side of the blade, wherein each stabilizing member extends from the contact edge and defines a stabilizing surface substantially coplanar with the underside of the blade for providing stability to the apparatus when the contact edge of the base is engaged with the side edge of the sheet material and the underside of the blade is engaged with the surface of the sheet material, wherein each stabilizing member includes an upwardly extending side edge portion for facilitating movement of the base along the sheet material side edge without the stabilizing members engaging irregularities in the sheet material surface; and handle structure provided on the base for manual engagement by a user for enabling the user to move the base along the side edge of the sheet material;

wherein the openings in the blade are adapted to receive a tip of a marking or scoring instrument to provide a mark or a score on the surface of the sheet material as the base and blade are moved along the sheet material with the contact edge of the base in engagement with the side edge of the sheet material.

2. The apparatus of claim 1, wherein the blade includes a plurality of sets of spaced openings, wherein each set includes a series of openings offset from each other in a direction parallel to the longitudinal axis of the blade and in a direction transverse to the longitudinal axis of the blade.

3. The apparatus of claim 1, wherein the upwardly extending side edge portion of each stabilizing member faces toward a side edge defined by the blade.

4. The apparatus of claim 1, wherein the contact edge of the base is defined at least in part by a lip member extending downwardly from an upper portion defined by the base.

5. The apparatus of claim 4, wherein the handle structure comprises a protrusion formed integrally with the material of the base.

6. The apparatus of claim 5, wherein the protrusion extends upwardly from an upper surface defined by the base.

* * * * *